US009975688B2

(12) United States Patent
Benouali et al.

(10) Patent No.: US 9,975,688 B2
(45) Date of Patent: May 22, 2018

(54) DISPENSER FOR DISPENSING A UNITARY DOSE OF AN ACTIVE SUBSTANCE IN A SOLID DOSAGE FORM

(71) Applicant: Medicodose Systems, Marseilles (FR)

(72) Inventors: Nadir Benouali, Marseilles (FR); Nissab Benouali, Marseilles (FR)

(73) Assignee: Medicodose Systems, Marseilles (FR)

( * ) Notice: Subject to any disclaimer, the term of this patent is extended or adjusted under 35 U.S.C. 154(b) by 0 days. days.

(21) Appl. No.: 14/902,413

(22) PCT Filed: Jul. 3, 2014

(86) PCT No.: PCT/FR2014/051705
§ 371 (c)(1),
(2) Date: Dec. 31, 2015

(87) PCT Pub. No.: WO2015/001262
PCT Pub. Date: Jan. 8, 2015

(65) Prior Publication Data

US 2016/0207691 A1 Jul. 21, 2016

(30) Foreign Application Priority Data

Jul. 5, 2013 (FR) ..... 13 56651

(51) Int. Cl.
*B65H 3/00* (2006.01)
*B65D 83/04* (2006.01)
(Continued)

(52) U.S. Cl.
CPC ..... *B65D 83/0409* (2013.01); *B65D 25/101* (2013.01); *B65D 49/12* (2013.01);
(Continued)

(58) Field of Classification Search
CPC .. B65D 83/0409; B65D 49/12; B65D 25/101; B65D 51/26; B65D 51/30; B65D 81/266; B65D 2215/02
(Continued)

(56) References Cited

U.S. PATENT DOCUMENTS 3,785,525 A * 1/1974 Handeland ..... B65G 47/1471 221/15
3,927,484 A * 12/1975 Spiegel ..... B65D 25/36 40/306
(Continued)

FOREIGN PATENT DOCUMENTS

DE 202007018407 U1 7/2008
EP 0857665 A1 8/1998
(Continued)

OTHER PUBLICATIONS

Written Opinion, PCT/FR2014/051505 filed Mar. 7, 2014.

*Primary Examiner* — Rakesh Kumar
(74) *Attorney, Agent, or Firm* — Fox Rothschild LLP

(57) ABSTRACT

The invention concerns a secure device for dispensing unit doses (Mi) of an active substance in a solid dosage form. Such a device comprises means to prevent refilling of the chamber containing the unit doses. It may further accommodate a processing unit and means of communication with the outside world. Such a device is particularly effective when it comes to combating the counterfeiting of medicines. It may further be used to detect patients' non-adherence during a clinical trial or the non-adherence of a patients suffering from chronic diseases.

20 Claims, 4 Drawing Sheets

Figure 1A:
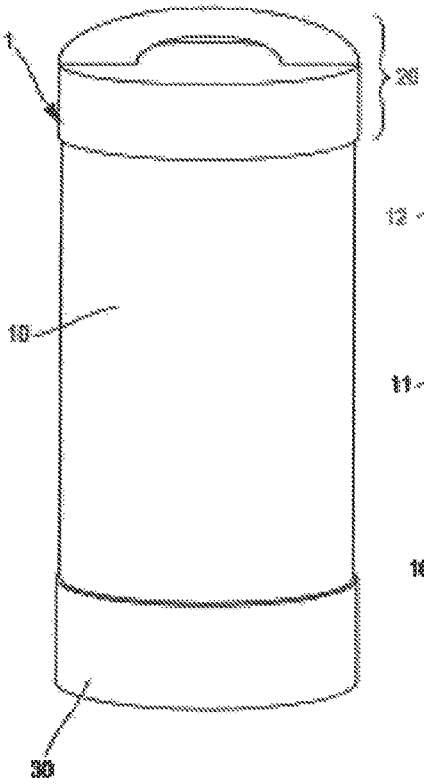

(51) Int. Cl.

| | |
|---|---|
| ***B65D 25/10*** | (2006.01) |
| ***B65D 81/26*** | (2006.01) |
| ***B65D 49/12*** | (2006.01) |
| ***B65D 51/26*** | (2006.01) |
| ***B65D 51/30*** | (2006.01) |

(52) U.S. Cl.
CPC ..... *B65D 51/26* (2013.01); *B65D 51/30* (2013.01); *B65D 81/266* (2013.01); *B65D 2215/02* (2013.01)

(58) Field of Classification Search
USPC ..... 221/270
See application file for complete search history.

(56) References Cited

U.S. PATENT DOCUMENTS 4,150,766 A * 4/1979 Westendorf ..... B65D 83/0409 221/112
4,273,254 A * 6/1981 Cuppleditch ..... B65D 83/0409 221/196
4,518,828 A * 5/1985 Geboers ..... H04M 19/08 379/361
4,560,086 A * 12/1985 Stol ..... B65D 83/0409 198/724
4,611,727 A * 9/1986 Graff ..... B65D 83/0409 206/540
5,176,290 A * 1/1993 Schwarzli ..... G07F 11/24 221/200
5,269,413 A * 12/1993 Stern ..... B65D 51/26 206/37
5,476,181 A * 12/1995 Seidler ..... B65D 50/061 206/536
5,833,117 A * 11/1998 Kovens ..... G07F 11/44 221/155
7,213,723 B2 * 5/2007 Schwarzli ..... G07F 11/44 221/165
7,249,687 B2 * 7/2007 Anderson ..... A61M 15/0045 128/203.15
8,408,208 B2 * 4/2013 Bacon ..... A61M 15/009 116/284
2002/0153005 A1 * 10/2002 Scarrott ..... A61M 15/009 128/200.14
2005/0279760 A1 * 12/2005 Yao ..... G07F 11/24 221/265
2013/0256331 A1 * 10/2013 Giraud ..... B65D 83/0409 221/1
2016/0207691 A1 * 7/2016 Benouali ..... B65D 25/101

FOREIGN PATENT DOCUMENTS

EP 2289480 A2 * 3/2011 ..... A61J 1/03
EP 2289480 A2 * 3/2011 ..... A61J 1/03
FR 3007969 A1 * 1/2015 ..... B65D 25/101
WO 2007081947 A2 7/2007
WO WO-2007081947 A3 * 4/2009 ..... A61J 7/0038
WO 2011154018 A1 12/2011
WO WO-2011154018 A1 * 12/2011 ..... B65D 83/0409

* cited by examiner

DISPENSER FOR DISPENSING A UNITARY DOSE OF AN ACTIVE SUBSTANCE IN A SOLID DOSAGE FORM

CROSS-REFERENCE TO RELATED APPLICATIONS

This application is the U.S. National Phase of International Application No. PCT/FR2014/051705, filed Jul. 3, 2014, which claims priority to French Application No. 1356651, filed Jul. 5, 2013, the disclosure of which is incorporated herein by reference.

The invention concerns devices for dispensing unit doses of a drug substance in a solid dosage form. Specifically, it concerns the fight against the counterfeiting of medicinal products and patients' non-adherence towards clinical trials protocols or non-adherence of chronically ill patients.

The counterfeiting of medicines is a global phenomenon. Studies have shown that counterfeit medicines account for over 10% of the global drug trade. In certain developing countries, as many as one drug in two might be a counterfeit. According to the World Health Organisation, counterfeiting generates a black economy worth over $75 billion annually, highlighting the fact that the so-called developed countries are not spared. Since 1992, a large number of World Health Organisation (WHO) Member States, Interpol, the World Customs Organization, the International Narcotics Control Board, the International Federation of Pharmaceutical Manufacturers, the International Consumers organizations as well as the International Pharmaceutical Federation approved the following definition: "A counterfeit medicine is a product which is "deliberately and fraudulently mislabeled with respect to identity and/or source". Counterfeiting can apply to both branded and generic medicinal products and counterfeit products may include products with the correct or the wrong ingredients or excipients, without active ingredients, with insufficient active ingredients or with fake packaging."

Drug counterfeiting directly affects patients' health and safety. It also compromises the finances of companies operating in the sector as well as governmental agencies.

By way of example, the effects induced by a counterfeited medicine, which fails to reproduce the characteristics of the medicine that has been counterfeited may lead to treatment failure and can also induce resistance to certain drug substances such as antibiotics. A counterfeit medicine can threaten a patient's health or cause the exacerbation of a disease via diverse complications. It can also directly cause the death of the patient, especially in the frailest populations like children and the elderly.

The pharmaceutical industry is well aware of the dangers associated with malicious counterfeiting which is on the rise. It also measures the significant financial shortfall of the order of six billion euros a year for French pharmaceutical companies only, and attempts to implement new strategies to combat counterfeiting, notably by trying to secure its packaging chains and distribution channels.

National agencies are also being mobilized to address this phenomenon. Governments also suffer significant financial losses: the threat to public health engenders substantial expenses to cover the health care costs for people who may have been exposed to harmful products as well as for the replacement of stocks of counterfeit drugs. Reinforcement of control and surveillance services for pharmaceutical supply channels on the ground is also consuming ever-increasing resources.

The solutions and strategies developed to date or implemented by those concerned have proven to be expensive and relatively ineffective. Worse still, in the opinion of some observers, these strategies, although considered essential, could even curb investment devoted to research and limit the development of new molecules. Counterfeiters are particularly ingenious and they manage to reproduce almost identical-looking bottles, vials, blister-packs, tablets and capsules, but obviously not active ingredients. Some even recycle empty original containers; refill them with counterfeit medicines and reintroduce said containers on the market.

The pharmaceutical industry faces a second problem associated with the non-adherence of patients to clinical trials protocols. The objective of a clinical trial is to assess the effects of an active substance on patients who consent to follow a strict protocol, especially with respect to drug regimen. They also have to make a precise report or fill in a clinical questionnaire about any positive or negative effects they have observed. Compliance with drug intake is crucial in clinical phases in clinical trials' phases because it is the only way of establishing the most effective, non-toxic dose or the correct dosage to recommend in a specific therapeutic indication. Therefore, failure to comply with or adhere to a protocol by the patient, such as taking the medication at random, results in the collection of inaccurate or insufficient data. Biased clinical trials can lead to the abandonment of a potentially effective drug or, conversely, to the approval of a drug of dubious efficacy or even one that is toxic at the established dosage. Patients' non-adherence towards clinical trial protocols is unfortunately a widespread behavior. The average cost of developing a new drug is estimated at nearly one billion euros. The time required to obtain a Marketing Authorization or capitalize on research is of the order of twelve years (and sometimes longer). Combatting patient non-adherence during clinical trials or at least detecting it constitutes a second challenge for the pharmaceutical industry. It is essential to reduce the costs and time associated with conducting clinical trials to improve the relevance and quality of the results thereof by improving the adherence of enrolled subjects with the clinical protocols. Stakeholders, therefore try to raise patients' consciousness and commitment through informative pamphlets, hotlines, Web sites, etc. To help patients follow protocols and the clinician's recommendations, some have tried to establish systems to remind them when to take their drug and their scheduled appointments with the clinician. Reminders might be through telephone calls, E-mails or electronic diaries. Others have developed new forms of "smart" pack, e.g. with a timer to remind the patient when to take a dose. Such solutions are very expensive and do not allow to measure and therefore to detect patient's non-adherence to a clinical protocol.

The invention provides an answer to most of the disadvantages of current solutions.

Among the many advantages of the invention, the following can be singled out:

- To fight effectively against malicious counterfeit medicines attesting consistency between the content and the container
- it provides economical containers or dispensers adaptable to all solid dosage forms of drug substances;
- according to variants embodiments:
  - To deploy drug dispensers in regions with a high degree of atmospheric humidity thus, preserving the drug substances of medicines and their integrity;
  - To prevent damage of drug dosage units, resulting from collisions between said doses within the dispenser;

To limit the risk of accidents or drug poisoning by preventing the delivery of a dose to an unmonitored child while maintaining easy use by the elderly;

To assess patients' adherence with the clinical trial protocol or non-adherence in patients suffering from chronic disease;

To contribute to the implementation of patient assistance services during a therapeutic treatment.

To this end, a dispenser is notably intended to dispense a unit dose of an active substance in a solid dosage form. Such a device includes a chamber to hold multiple unit doses of said drug substance, a command mechanism that can be activated by the user, means for extracting from said chamber and delivering a single unit dose of the plurality in the chamber in response to actuation of the command mechanism by the user, and a casing or housing cooperating with the chamber. To effectively combat drug counterfeiting, such a device is specially designed to prevent malicious refilling of the chamber. Moreover, it also controls the dispensing of a unit dose to the patient.

For this, the said envelope irreversibly encloses or encircles the chamber and includes means, which, if the envelope is damaged, attest, emphasize or accentuate the said alteration. Furthermore, the unit dose extraction and dispensing system includes a mechanism to prevent the return of a unit dose back into the chamber.

By virtue of the invention, the chamber cannot be refilled without damaging the envelope of the device or the mechanism designed to prevent reintroduction, such damage thereby bearing witness to fraudulent activity or forced entry.

To preserve active ingredients in certain substances, the quality of coatings, or to carry dispersible tablets in a device that can be used in a very humid country or geographic area, a device according to the invention could also include means of absorbing humidity to maintain a dry atmosphere inside the chamber.

To maintain the integrity of unit drug doses in the dispenser's chamber and protect them against alteration resulting from collisions between said unit doses, a device according to the invention can advantageously include means to exert sufficient pressure on the unit doses inside the chamber to immobilize them.

To reduce the risk of drug intoxication, dispensing a unit dose of a drug substance using a device according to the invention can be made easy for any patient (including the elderly) apart from young unattended children. With this in mind, the command mechanism of a device according to the invention can be designed so that it requires two distinct actions by the user to activate the respective means for extracting and dispensing the unit dose.

To prevent a unitary dose taken out of the chamber being dispensed and possibly getting dirty, a device according to the invention can advantageously include a receptacle to collect the unit dose extracted out of the chamber by the extraction and dispensing means. According to an advantageous embodiment, the chamber of a device according to the invention can be constituted by the envelope's inner wall.

In a variant, said chamber can be constituted by an insert.

According to a preferred embodiment, the means of extraction and dispensing of a device according to the invention can include a tube in the shape of a circular helix which can carry one or more unit doses, the said tube being inside the chamber which has an orifice at its lower base, the lower distal portion of the tube opening of said chamber by said orifice.

To indicate that a device according to the invention has never been used, it may advantageously comprise means indicating the absence of any initial distribution of a unit dose. According to a first embodiment, such means showing that no unit dose has ever been dispensed before could consist of a stopper on the unit dose dispensing. Alternatively or additionally, they may consist of an accessory that locks the command mechanism operable by the user.

To increase the fight against counterfeiting, fulfill the requirements of assistance services for patients suffering from chronic disease, or even to measure the adherence of a patient to a clinical trial protocol, a device according to the invention could also contain a level with a processing unit cooperating with the command mechanism, and a source providing required electrical power to operate the said processing unit. Such a processing unit may have a timer and a memory to timestamp and record every operation of the command mechanism that triggers the extraction and dispensing system.

In a variant, the extraction and dispensing system of such a device can include a sensor for detecting the delivery of a unit dose. According to this variant, the device may have a level containing a processing unit cooperating with said sensor, and with an electrical power source to supply said processing unit which also includes a timer and a memory to timestamp and record every dispensing of a unit dose detected by the sensor.

To protect the level and the elements at contains, the invention states that the envelope of a device according to the invention may advantageously enclose the chamber as well as said level.

To exploit the memory of a processing unit in a device according to the invention, said processing unit can advantageously include a wireless interface for communication with the outside world. In a variant or as a complement, the processing unit may include a hard-wired communication interface for communication with the outside world. Similarly, a device according to the invention can include a human-machine interface capable of retrieving information stored in the memory or generated by the processing unit, the latter driving said human-machine interface.

To trace a device according to the invention when it contains a processing unit, the unit's memory may include first and second identifiers, dedicated to the device and an operator who originally filled the chamber, respectively. Said memory can also have an identifier characterizing an active drug substance in a solid dosage form contained in the chamber.

To prevent malicious and secondary exploitation of a device according to the invention or to prevent any attempt to alter the contents of the memory of a processing unit enclosed in the device; the said memory could be advantageously designed to be non-erasable.

According to a second object, the invention concerns a process implemented by the processing unit of a device in accordance with the invention when the latter encloses a processing unit having a communication interface with the outside world.

Such a process includes:

a step to timestamp each unit dose extracted from the chamber and dispensed;

a step to encode and restore to the outside world information generated from the contents of the processing unit's memory.

According to a third object, the invention concerns computer software containing one or more program instructions that, when interpreted or executed by the processing unit of a device according to the invention, launch the above-mentioned process.

Figure 1B:
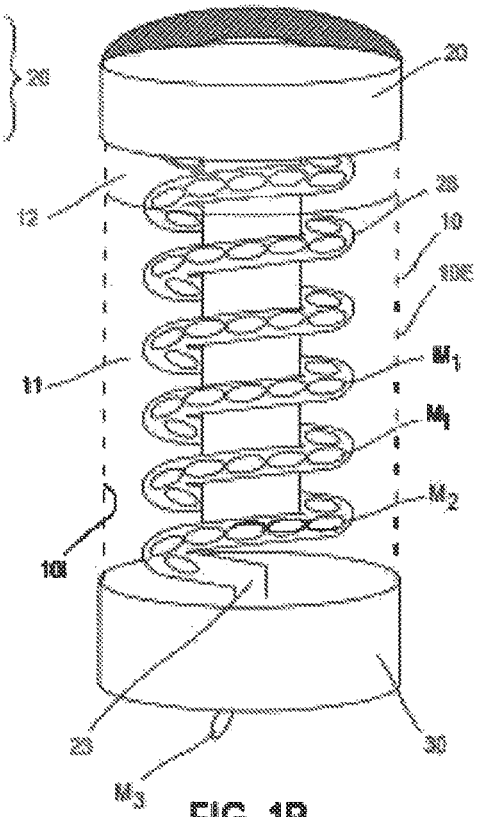
Figure 2A:
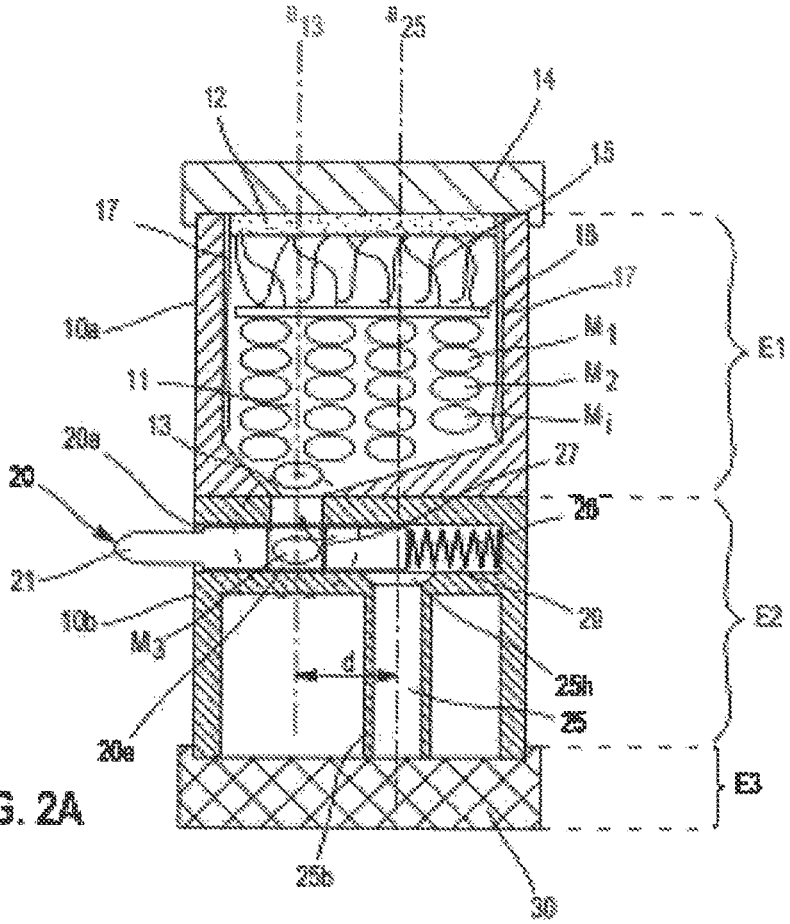
Figure 2B:
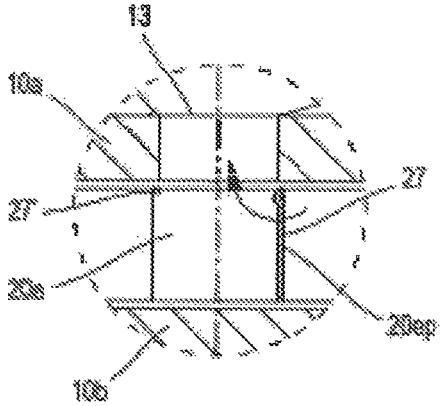
Figure 3A:
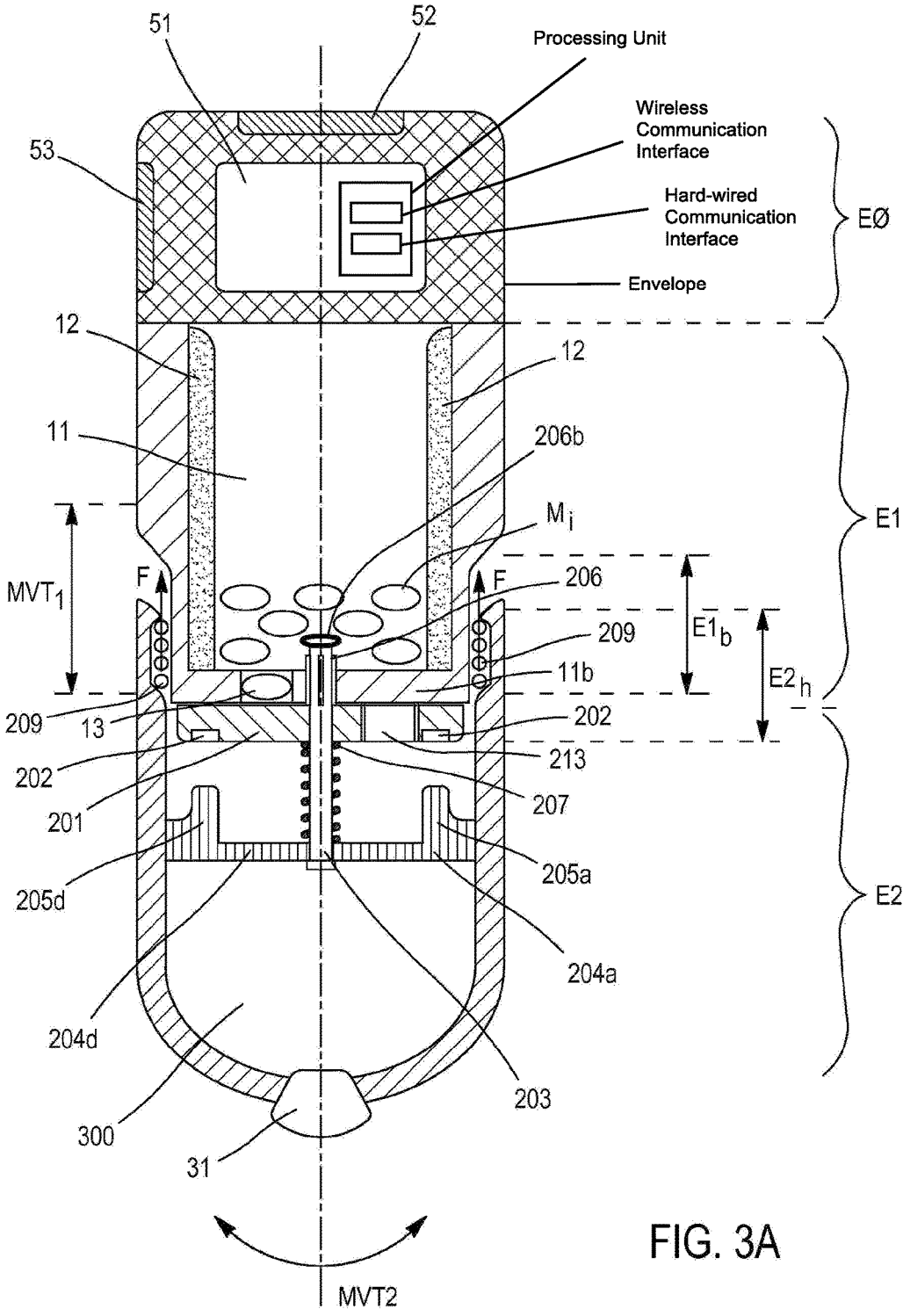
Figure 3B:
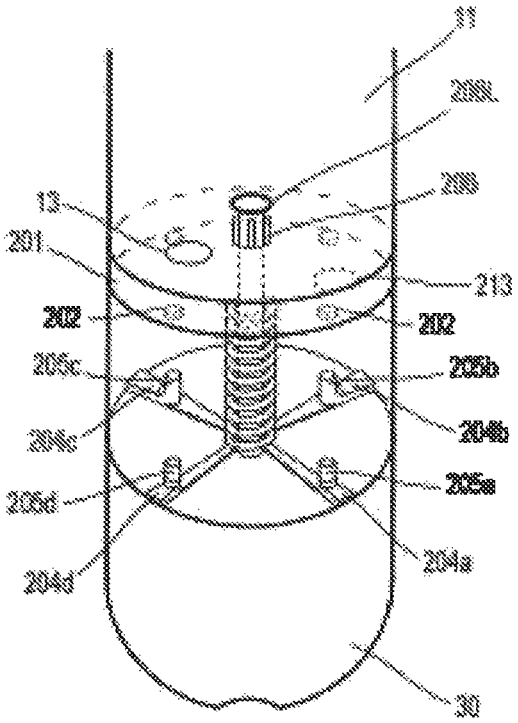

Other characteristics and advantages will become clearer from reading the following description and examining the accompanying figures, among which:

FIGS. 1A and 1B respectively describe the outer and inner views related to a first embodiment of a device according to invention;

FIGS. 2A and 2B describe a second embodiment of a device according to the invention which notably carries means to prevent any collision between the unit doses contained in the chamber; FIG. 2B is a partial enlargement of FIG. 2A to illustrate more accurately an example of a mechanism to prevent refilling of the device with unit doses;

FIGS. 3A and 3B describe a third embodiment of a device according to the invention which notably encloses a processing unit.

The invention concerns the dispensing of drug substances, mainly medicines, packaged in a solid dosage form. In the sense of the invention, a unit dose of such active drug substance in a solid dosage form means (in a non-exhaustive manner):

- so-called "standard" tablets or "pills" intended to be swallowed by a patient: it dissolves within the body and can be absorbed throughout the gastrointestinal tract;
- chewable tablets which are not intended to be swallowed, but sucked by the patient: the drug substance passes into the bloodstream through the oral mucosa;
- orodispersible tablets which dissolve in the mouth of the patient within seconds;
- sublingual tablets which are not intended to be swallowed directly by the patient, but to be placed under the patient's tongue where they will dissolve: the drug substance passes into the bloodstream via the highly vascular mucosa underneath the tongue;
- effervescent or otherwise dispersible tablets which rapidly disintegrate or break up, preferably in a glass of liquid;
- coated or sugar-coated tablets, or film-coated tablets designed to obtain a specific effect, e.g. gastro-resistance, mask color or unpleasant taste, confer a "commercial" color or affix a logo or a reference to the company that markets the drug;
- coated or uncoated effervescent tablets: an effervescent tablet is one designed to break up and dissolve quickly;
- a capsule with a soft or a hard shell consisting of a hollow case containing a drug substance; among the various types of capsules can be distinguished:
  - dipped capsules, oval-shaped and of varying size, referred to as capsules or capsulines;
  - pressure-generated capsules, oval or spherical in shape, referred to as globules or beads, produced in a machine that uses high pressure to weld together two thin sheets of gelatin paste to create a cavity containing a liquid, paste or powder;
  - soft or elastic capsules produced in a manufacturing process which is essentially the same as that used to make dipped capsules but with glycerin added into the formula to make the shell thinner and more flexible; these do not require drying before filling and are closed with a ring dipped in a gelatin solution: they usually contain oily substances;
- pills or lozenges, usually cylindrical or flattened spherical shape.

Furthermore, in the sense of the invention such a unit dose may consist of one or more tablets or capsules, said plurality of units forming a unit dose to be taken by the patient for a given posology. A unit dose can therefore consist of several units and be fully dispensed by actuating the command mechanism of a device designed to dispense drug substances to its user.

FIGS. 1A and 1B describe a first example of an embodiment of a device 1 to dispense a unit dose of a drug substance in a solid dosage form. More specifically, FIGS. 1A and 1B describe in more detail the outer (FIG. 1A) and inner (FIG. 1B) views of such a device. This device contains a chamber 11 holding multiple unit doses of active drug substance in a solid dosage form. As indicated in this example, chamber 11 is constituted, delineated or materialized by the inner surface 101 of envelope/envelope 10. Such a chamber could be cylindrical in shape as shown in the example described in FIG. 1B. Doses M1, M2, Mi—corresponding in the context of the example shown in FIG. 1B, to oval sugar-coated tablets—are present in the chamber 11. To extract and dispense a tablet (referenced M3 in FIG. 1B), the user activates a command mechanism. Referring to FIG. 1B, this mechanism advantageously takes the form of a lid or a handle 20. In response to the action, the command mechanism triggers means to extract a unit dose from chamber 11. The dose M3 is thus dispensed to the patient. Advantageously, such a dispenser may include a receptacle 30 with a window so that, when it is dispensed, the unit dose will not be elected with the risk of being dirty or contaminated before administration.

Referring to FIG. 1B, such means for the extraction and dispensing could advantageously take the form of a hollow tube 28 shaped like a circular helix designed to deliver one or more unit doses. This tube is inside chamber 11, which has an orifice at its lower base, the lower distal portion of tube 23 opening of said chamber by said orifice. Such a tube could be assembled to rotate around an axis substantially parallel to the axis of rotation of chamber 11. In addition, the tube is integral to the lid or handle. Thus, an action to partially or fully rotate said lid causes the routing of the unit doses present in the chamber to move along tube 28 which, like a guide, will direct a unit dose (i.e. M3) towards orifice 13 of the chamber. Such a unitary dose is thus extracted out of chamber 11 and dispensed to the patient, via the optional receptacle 30.

To combat the counterfeiting of medicines and more specifically to prevent secondary, fraudulent use of a container, the invention provides that envelope 10 of the device 1 can be designed to enclose the chamber 11 irreversibly after its original filling, thereby precluding any refilling of the chamber.

Referring to FIG. 1A, such an envelope 10 can for example be thermoformed. In a variant, it can result from the assembly of a plurality of parts that can be mutually welded or glued. Each part could include means for irreversible fitting (e.g. clips) so that by the end of an assembly phase, all the parts form a single unit or confinement chamber for the unit doses.

To attempt using a device according to the invention in a fraudulent fashion, it becomes necessary to alter the integrity of the envelope to access chamber 11. According to a preferred embodiment, such an envelope 10 can be fitted with means that, if any attempt is made to breach it, indicate or attest said attempt. Envelope 10 could e.g. carry a series of either printed or engraved guilloche motifs on the outer surface 10*e*. Alternatively or additionally, envelope 10 can also have—by virtue of its features or structure, areas of weakness or weak breaking zones which, when an attempt is made to tamper with the envelope, automatically accentuate any damage inflicted to the envelope's physical structure. In addition, or as a variant, other techniques could be used to render the chamber incompatible with holding the unit doses in response to the attempted tampering, e.g. by means of an ink projection system. The invention is not limited solely to these examples of methods to indicate any attempt to tamper with the integrity of the envelope 10. According to the example described in FIG. 1A, the envelope thus formed after its original filling may be rigid, flexible or semi-rigid according to the desired packaging, the device's planned use, required specifications or local regulations. Any type of material can therefore be used, such as plastic, metal, polymers, etc.

The envelope and, therefore, chamber 11 can be substantially cylindrical as described in FIGS. 1A and 1B. Variants of one or the other could be presented in other geometrical configurations, e.g. a cone, a solid with a polygonal section, half-moon section, etc.

According to the example described in FIG. 1B, the chamber is directly delineated by the inner wall 10*i* of envelope 10. To prevent any interaction between the lining material of the envelope and the unit doses, the inner wall 10*i* of the envelope 10 can advantageously comprise a plurality of protective layers, e.g. food-grade varnish. Thus ensuring optimum neutrality of the inner surface of the envelope with respect to the contents of chamber 11.

As a variant, chamber 11 can consist of an insert. e.g. a sleeve, cartridge or cassette (not shown in FIG. 1B) can be enclosed within envelope 10. The insert is initially filled with unit doses. This variant notably makes it possible to dissociate the unit dose batch constitution—filling the insert—from the final packaging step—assembling a device accord to the invention. This variant also precludes the need to deposit any protective material on the inner surface of the envelope to prevent any interaction between the envelope material and the unit doses. The latter being protected by the insert.

Dispensing some drugs in countries or regions with high atmospheric humidity can be difficult: in contact with humidity, active ingredients of certain medicines, the quality of coatings or the integrity of dispersible tablets can be quickly damaged in contact with humidity. To preserve unit doses stored in the chamber of a device according to the invention, the chamber can also advantageously further contain means to absorb humidity 12 to sequester ambient moisture and thereby maintain a dry atmosphere within the chamber 11. According to the example described in FIG. 1B, the upper portion of the chamber 11 comprises a strip of blotting paper or any other material that sequesters or absorbs ambient humidity or condensation inside the chamber. Additionally or alternatively, such means could be implanted at other points within the device 1.

As a complement, a device according to the invention can also include means to indicate that no unit dose has been dispensed. By way of a non-exhaustive example, such means might consist of a stopper that blocks the dispensing of unit doses, e.g. a membrane seal that is well visible to the user of the device. Advantageously, such a stopper may cooperate with receptacle 30 to obscure the window of said receptacle. It could alternatively cooperate with the envelope or constitute an extension or accessory to said envelope. The layout of the said stopper is advantageously designed so that its removal would be and remains visible to the user, e.g. the removal of the stopper could leave visible damage on the envelope or receptacle in such a way at one glance the user can see that the device has already been used. In a variant or as a complement, said means indicating the absence of any previous dispensing of a unit dose could consist of a mechanism or accessory designed to lock the command mechanism 20 that is operated by the user in order to trigger the dispensing of a unit dose. Thus, to deliver the first unit dose, it becomes necessary to remove said lock to release the command mechanism. For example, such means can consist of a patch or an adhesive strip, which removal could advantageously not necessarily leave visible fragments on its support, or alternatively a strip cooperating e.g. together with the lid or the handle 20 and the device's envelope or body.

FIG. 2A describes a second embodiment of a device 1 according to the invention. Such a device comprises a chamber 11 to contain a plurality of unit doses M1 to Mi. The device 1 advantageously consists of two or three levels or modules. The upper level E1 consists of a hollow cylinder with a concave lower base E1*b*. In the hollow of said lower base, there is an opening 13, the shape of which substantially matches that of a unit dose. Furthermore, according to the example described in FIG. 2A, the lower base of level E1 is laid out so that said opening 13 or the tip of inverted cone on the base is offset with respect to the axis of rotation all of the chamber constituted by the inner wall of said level. The unit doses can be arranged inside the chamber 11 at the upper opening E1*h* of level E1. Once the chamber is filled with unit doses, the upper section of the chamber 11 is sealed with a (lid) 14. The latter irreversibly cooperates with the upper portion E1*h*, which may be bonded through welding, glue, clips, etc. The chamber 11 constituted by the inner wall of the upper level E1 would then have only one opening, namely opening 13.

To maintain a dry atmosphere inside the chamber 11, the lid 14 can include means to absorb ambient humidity such as blotting paper, etc. In addition, to prevent collision between said unit doses inside the chamber 11, the lid 14 can comprise a set of spiral wicks 15 or any other equivalent system, such as, springs, elastic fibers, etc., the function of which is to apply sufficient pressure on the unit doses located at the top of chamber 11. Gradually, the unit doses are leaning against each other and become immobilized. As shown in FIG. 2A, a pressure disc 16 can advantageously be inserted between said spiral wicks 15 and the unit doses, the lower surface of which (i.e. the one in contact with the unit doses) has an inert coating to prevent any direct contact between the spiral wicks 15 and the unit doses. As a variant, the pressure disc 16 can be entirely made of an inert coating or material. As for the device 1 described in FIG. 1B, the inner surface of the chamber 11 can be coated with a protective varnish.

With such a layout of the upper level, the unit doses are naturally pushed by gravity and the effect of the spiral wicks towards opening 13 of the chamber 11 when the device is held in a more or less vertical position.

The device 1 comprises a second level E2 which function is to extract one unit dose among the plurality of unit doses contained in the chamber 11 and to dispense the dose extracted to a patient or more generally to a device 1 user.

Level E2, below level E1 when the device 1 is held more or less vertical, includes a dispensing channel 25 substantially parallel to the axis of rotation all of the chamber 11. The axis of rotation a25 of said channel 25 is also substantially parallel to axis a13, which is perpendicular to the cross-section of opening 13. Axes a13 and a25 are offset in such a way that channel 25 does not emerge facing opening 13. The distance between axes a13 and a25 is greater than or equal to the maximum dimension of the unit dose in chamber 11. In connection with the example described in FIG.

2A, level E2 looks like a cylinder with an external diameter substantially identical to that of level E1.

The upper portion of level E2 further comprises a transversal groove 29 perpendicular to the axis of rotation of level E2. Groove 29 also intersects with the channel 25, which emerges in said groove 29. Such groove 29 only opens at one end. It constitutes a groove in which a command mechanism 20 can slide along. For a groove 29 with a circular section, the mechanism 20 advantageously looks like a full cylinder arranged to slide in said housing. The housing and mechanism 20 could have sections that are not circular but would be matched so that the mechanism can slide inside the housing. The command mechanism 20 is long enough so that its distal part 21 thereof remains projected out. The mechanism 20 can advantageously include a shoulder 20*a* so that its course is limited in the groove 29, the shoulder acting as a stop against the inner surface of level E2. The command mechanism 20 cannot therefore be removed after assembly of the device 1. The groove 29 also features a spring or cylinder 26 cooperating with the inner surface of level E2 and the proximal part (i.e. internal) of the command mechanism 20. The command mechanism 20 thus resembles to a push button, the course of which inside the level is limited by the shoulder 20*a* and the resistance of the spring 26. The command mechanism 20 advantageously has a full structure apart from a traversing recess 20*e* with a cross-section similar to that of the opening 13. Like a cradle, the mechanism 20 can thus convey a unit dose inside groove 29. The traversing recess is laid out so that a single unit dose is extracted by gravity out of chamber 11 and received in said recess when the mechanism 20 is in its resting position (the spring 26 pushing said mechanism back until the shoulder 20*a* is stopped against the inner surface of level E2) and when the device 1 is held so that level E1 is positioned above level E2.

When the command mechanism is actuated by a user of the device 1, said mechanism 20 enters the groove 29 and stretches the spring 26. The traversing recess 20*e* transports the unit dose, the latter resting on the lower wall of groove 29. When the recess 20*e* is facing channel 25, the unit dose is released and dispensed by simple gravity. During the path of the command mechanism 20, the opening 13 of the chamber 11 is blocked by the body of the command mechanism 20. When the user of the device releases the command mechanism 20, the spring 26 pushes it back to its resting position. In turn, the body of the mechanism 20 blocks the channel 25. The opening 13 of the chamber is again facing the recess 20*e* and a unit dose can therefore take place within the recess 20*e*. To make sure that only one unit dose can be conveyed, the height of the recess 20*e* is close to that of one unit dose.

To join or seal together levels E1 and E2, said levels advantageously include irreversible, matching joining points. Thus, the lower part of level E1 and the upper part of level E2 are laid out to cooperate with one another in an irreversible manner, using, e.g. means of a weld, glue, clips, etc. The respective outer walls of levels E1 and E2 as well as that of the upper lid 14 constitute the envelope 10 of the device 1. Thus enclosing not only the chamber 11 but also the unit dose extraction and dispensing system.

So that the extracted, dispensed dose does not fall straight out, the device 1 may include a receptacle 30. This constitutes the lower level E3 of the device 1. In contrast to the other two levels that are mutually and irreversibly assembled, receptacle 30 cooperates with the lower base of level E2 reversibly, e.g. through a thread or an adjustment affording enough friction to keep the receptacle in position. Thus a user can remove the receptacle 30, recover the unit dose and then reposition said receptacle 30 on the lower base of the level E2. The lower part of the channel 25 is again closed. The use of the receptacle makes it possible to associate to the actuation of the mechanism a second operation required for dispensing a unit dose. Young children are thereby protected because they should be unable to reproduce these two consecutive actions. In a variant or as a complement, the invention provides for the possibility of associating a complementary mechanism to block/release the path of the command mechanism 20. By way of example, there could be a split pin or a second push button (not shown in FIG. 2A) that can be actuated by the user to release the path of the mechanism 20 inside the groove 29. This constitutes a mixed meta-command mechanism, which requires two distinct actions by the user to extract a unit dose from chamber 11 and dispense said unit dose to the user of the device 1.

Such a layout can dispense only a single unit dose per actuation of the command mechanism. To dispense a plurality of tablets or capsules that together constitute a plural unit doses, simply adjust the dimensions, particularly the depth of recess 20*e*, so that the latter can accommodate the relevant number of tablets or capsules.

To prevent fraudulent refilling of the chamber 11, the envelope of the device resulting from the assembly of levels E1 and E2, and possibly lid 14, can include any means, such as those described above referring to a device 1 according to FIGS. 1A and 1B, the function of which consists in emphasizing any tamper attempt or even exacerbating the damage caused by such an attempt. Such a device can also include means to bear witness that no unit dose has ever been dispensed before. Thus, following the example of the device illustrated in FIG. 1A or 1B, such so-called "tamper-evident" means can advantageously consist of a shutter means for dispensing a unit dose. By way of example, such a shutter could consist of a seal or adhesive strip joining the receptacle 30 and the lower surface of the level E2 until it is deliberately removed. As a variant, such means confirming that no unit dose has ever been dispensed before could also consist of an accessory to block the command mechanism 20 as long as said accessory has not been removed or altered.

In addition, in order to prevent filling of the chamber via the channel 25, a device according to the invention could include means to prevent any "return" of a unitary dose back into the chamber 11.

By way of a non-limiting example, such means could consist of one or more flaps designed to close the opening 13 of the chamber 11 or the channel 25. Thus, as it is notably described in FIG. 2B, the inner proximal wall of the recess 20*e*, i.e. the wall closest to the end remaining inside the groove 29 of the mechanism 20, can cooperate with a flap 27. This operation can be achieved by means of a pivot link positioned in the upper part of the recess with a length more or less equal to the breadth of said recess 20*e*. Such a flap is naturally kept flattened against the inner wall of the recess 20*e* when a unit dose initially present in the chamber 11 occupies the recess. Even if no unit dose is present in said recess 20*e* or the chamber, the flap 27 remains flat against the wall of the recess for as long as the device is kept more or less vertical, i.e. when the level E1 is above level E2. Once the orientation of the device varies, the flap 27 closes all or part of the opening 13. It closes completely the latter if the device is held vertically "upside down", i.e. when the level E2 is positioned above level E1. Rotation of the flap 27 is restricted by the presence of a small stop 27 on the opposite inner wall in the recess 20*e*. Said stop 27 is advantageously disposed so as not to hinder passage of a unit dose through the opening 13 and its accommodation in the recess 20*e*. This simple flap 27 prevents any attempt to fill the chamber 11 via the dispensing channel 25. To try to achieve such an operation, it is necessary to turn the device upside down with the distal part 25*b* of the dispensing channel 25 pointing up, to introduce a "fraudulent" dose in said channel 25, to actuate the command mechanism 20 so that the recess 20*e* comes in front of the channel 25 and thus introduce said dose into the recess 20*e*. By releasing the mechanism 20, the recess is positioned at the opening 13 of the chamber 11. The flap 27 remains positioned between the injected unit dose and the opening 13. The unit dose cannot enter the chamber. Other techniques or flaps could be positioned to block displacement of the command mechanism 20 or to block the transfer of a dose into the channel 25 when a dose moves from the distal part 25*b* of the channel 25 towards the groove 29. To keep the atmosphere dry in the optional receptacle 30, it could contain means of absorbing humidity and/or condensation (not shown in FIG. 2A).

FIG. 3A described a third embodiment of a device for dispensing a unit dose according to the invention. A first level E1, substantially cylindrical and hollow, encloses a chamber 11 designed to store unit doses M1, M2, Mi. The cylinder E1 is closed at its lower base 11*b*. Said base carries an opening 13, with a configuration that substantially matches the dimensions of a unit dose. The thickness of the cylindrical wall of level E1 tapers towards the bottom over a height E1*b*, in such a way that level E1 can be inserted into the upper part of a lower level E2 (described hereafter). The upper part of level E1 can be closed using a lid or, as will be seen later, by an upper level E0. Said lid or the lower part of the said optional upper level E0 cooperates with the upper part of level E1 and is sealed to the latter in a permanent and irreversible link by welding, glue, clips, etc. The chamber 11 is therefore delineated by the inner surface of level E1. This inner wall can advantageously include a layer of food-grade varnish or any other protective layer to prevent interaction between the unit doses and the material composing E1. The inner wall of the chamber 11 can also include one or more strips of some material that absorbs humidity or condensation 12 to dry out the atmosphere within the chamber 11.

The level E2, below the level E1, consists of hollow cylinder, the external diameter of which is substantially identical to that of the upper part of level E1. The thickness of the cylindrical wall of the upper part of level E2 is reduced over a height E2*h* substantially equal to the above-described height E1*b*. The two levels E1 and E2 can therefore cooperate, the lower part of E1 sliding into the upper part of E2 over a distance substantially equal to heights E1*b* and/or E2*h*, respectively. An internal shoulder on the upper section of level E2 can be used to fix a spring 209 inserted between the inner surface of E2 and the outer wall of E1. This spring 209 exerts a force F that tends to mutually push back both levels.

Level E2 further comprises an internal structure, e.g. a star-shaped structure having four arms 204*a*, 204*b*, 204*c*, 204*d* substantially orthogonal to the axis of rotation of level E2. The invention is not limited to the said number of arms or to this configuration of the structure. Said arms meet substantially at a point intersecting with the axis of rotation of level E2. Said junction of the arms also cooperates according to a fixed link with a torsion shaft 203, the axis of rotation of which substantially coincides with that of level E2. Said shaft is of such a length that it can emerge through an opening inside chamber 11 of level E1 after assembly of the two levels. Each arm 204*a* through 204*d* has a prominent lug following a direction close to that of the torsion shaft 203.

The invention provides that a disc 201 with an opening 213 similar to the opening 13 of the chamber 11, should be mounted to rotate on the torsion shaft 203. The disc 201 is positioned on the shaft 203 to be applied substantially against the outside wall of the lower base 11 *b* of level E1. A spring, such as a coil spring 207 around the shaft 203 keeps the disc 201 substantially flattened against the lower base of level E1 so that it slides along the torsion shaft 203. The lower side of said disc 201, i.e. the side opposite that in front of the level E1, carries as many recesses 202 (four in our example) as there are arms on the star-shaped structure in level E2. Each recess 202 is laid out to receive the distal part of the lugs or protuberances 205 *a* through 205 *d*, the length of said lugs being set so that their distal parts only cooperate with the recesses 202 when the spring 209 is contracted. Advantageously, the respective ends of said spring 207 are joined on one side to the disc 201 and on the other to the base of the torsion shaft 203 to keep the recesses 202 aligned to the protuberances 205 *a* through 205 *d*. The distal part of the shaft 203—after assembly—is fixed to the lower part of the chamber 11, e.g. by means of one or more longitudinal lugs or prominent stoppers 206 on the distal part of the shaft 203, cooperating with an appropriate opening in the lower surface of the level E1. Such an E1-E2 layout allows a first "sliding"-type MVT1 movement of the lower part of level E1 in the upper part of level E2. The shaft 203 acts as a guide. It also restricts the course of level E1 by means of a stop 206 *b* located at the end of the shaft 203 emerging into the chamber 11. The E1-E2 arrangement described in FIGS. 3A and 3B also allows a second rotatory-type MVT2 movement of the level E2 with respect to the level E1. In practice, the torsion shaft 203 allows this MVT2 movement, e.g. through the action of a user. The torsion shaft 203 automatically brings levels E1 and E2 into relative resting positions by virtue of the spring function exerted by the shaft as soon as the user releases the mechanism.

The opening 213 of the disc 201 is similar to the opening 13 of the chamber 11. It is advantageously located at a distance or radius of the shaft 203, substantially equal to that separating the opening 13 of the said shaft. In contrast, the disc 201 is initially located, i.e. when levels E1 and E2 are in their relative resting positions, in such a way that the openings 13 and 213 face each other only when the torsion shaft reaches maximum torsion and when the disc 201 is blocked by the lugs 204*a* through 205*d*, these having entered the recesses 202 under the effect of sufficient pressure to squash the spring 209. A unit dose can therefore not be taken out of the chamber 11 and dispensed unless both movements—MVT1 and MVT2—are combined. This arrangement therefore offers an answer to the risk of unattended young children using the unit dose dispenser. In practice, two distinct operations are required to trigger the dispensing of a unit dose. The latter is extracted and dispensed by gravity, said unit dose coming out of the chamber 11 via the opening 13, crossing the opening 213 temporarily in alignment with the opening 13 and falling through the arms 205*a* through 205*d* into the lower part 300 of level E2, all provided that the device is held substantially vertical, level E1 being positioned above level E2. Thus, the command mechanismin—in the sense of the invention—consists of the combination of the two levels E1 and E2, which can be actuated with respect to one another by a user of the device 1.

The level E2 can be opened at its lower base, or lower part 300. It may alternatively have an inverted conical shape or dome to form a receptacle intended to receive an extracted unit dose. To be able to use said unit dose, a user can remove a cap 31 designed to close an opening in the lower part of the level E2. The lower part of E2 can also include means to absorb any humidity or condensation present in the receptacle of the lower base 300.

The assembly of levels E1 and 12 can be made irreversible, on one hand by setting or machining the stop 206*b* located on the distal part of the shaft 203 and by closing the upper part of the chamber 11 after it has been filled via the cover or the optional upper level E0. The device described in FIGS. 3A and 3B has an overall cylindrical configuration. As a variant it could include levels with polygonal or other-shaped sections.

To improve the fight against counterfeiting, satisfy the requirements of assistance services for patients suffering from chronic diseases and even measure the adherence of a patient to the clinical trial protocol, a device according to the invention, whatever its embodiment, may also include electronic means to identify the device or even the active substances contained in the composition of the unit doses in the chamber, or again to timestamp and record every time a unit dose is dispensed.

To accommodate, such electronic means, a device according to the invention could comprise a dedicated level.

The example described in FIG. 3A illustrates such an alternative embodiment. This contains a level E0 with a special housing 51 to house or contain a processing unit that cooperates with the command mechanism and a source of electrical power to drive said processing unit. By way of example, such a source might be a battery carried in said housing 51 or a photovoltaic cell 52 that cooperate with said processing unit. Such a processing unit (not shown in FIG. 3A) advantageously incorporates a timer and memory to timestamp and records every actuation of the command mechanism to trigger the unit dose extraction and dispensing system. Referring to the example illustrated in FIG. 3A, the level E1 can contain a stop that cooperates with the lower level to limit the torsion of the shaft 203. The processing unit can exploit this contact as a piece of information transmitted by the command mechanism, constituted by the combination of the two levels E1 and E2, confirming that a unit dose has been dispensed. The processing unit can use any protocol to relay this information, e.g. if levels E1 and E2 are made of materials that conduct electricity, contact between the two levels by means of the stop could constitute grounding or electrical repository detectable by the processing unit.

According to a second example, a device 1 described in FIG. 2A can be fitted with an end-of-run sensor to detect the force exerted by a user on the mechanism 20. Such a sensor could be located in the groove 29. As soon as said sensor is solicited by the proximal part of the mechanism 20, i.e. when the user has pushed said mechanism 20 into groove 29, said end-of-run sensor transmits the delivery information to the processing unit.

As a variant, the unit dose extraction and dispensing means could include a sensor to detect the dispensing of a unit dose as such. According to the example described in FIGS. 3A and 3B, such an optical or inductive sensor could be located on the disc 201 close to the opening 213. According to this variant, the processing unit no longer cooperates directly with the command mechanism but with the said sensor which transmits the information as soon as a unit dose crosses the opening 213.

Whichever solution is chosen, the processing unit can timestamp and record every time a unit dose is dispensed.

To preserve the integrity of housing 51 and all the components inside it, the invention provides that the envelope of a device according to the invention can advantageously enclose the chamber 11 and said housing 51. For this, referring to FIG. 3A, levels E1 and E0 can be sealed, i.e. cooperate via a fixed and irreversible link, e.g. by means of welding, glue, clips, etc. This envelope is materialized by the outer walls of the two levels E0 and E1. Selecting the level E0 to cover and thereby close the chamber 11 precludes the need for a special lid. The said envelope resulting from the assembly of levels E1 and E0 can contain any appropriate means attesting or even exacerbating any tamper attempt as mentioned above referring to the preceding embodiments described with reference to FIGS. 1A and 2A. The housing 51 can advantageously contain a non-conductive resin or foam to protect electronic components against humidity and condensation in said housing.

In order to be able to exploit the contents of the memory of a processing unit contained in a device according to the invention, said processing unit could advantageously include a wireless communication interface to communicate with the outside world. In a variant or as a complement, the processing unit can include a hard-wired communication interface to communicate with the outside world. In this way, communication can be established with a reader or terminal to collect, process and send back through an adequate human-machine interface the information that has been memorized or generated by the processing unit. The reader or terminal would be capable of implementing a communication protocol with the device's processing unit.

It is thus possible to trace a device according to the invention by consulting certain information recorded in the processing unit's memory, e.g. first and second identifiers respectively dedicated to the device and the operator who originally filled the chamber (e.g. a pharmaceutical company or any sub-contractor responsible for packaging the unitary doses of a drug), or alternatively an identifier characterizing an active substance in a solid dosage form contained in the chamber.

It is also possible to recover the history of unitary doses dispensing.

A device according to the invention can include a specific human-machine interface that is capable of sending back information recorded in the memory or generated by the processing unit, the latter controlling said human-machine interface. By way of example, the device 1 described in FIG. 3A can include a human-machine interface such as a flexible display 53, e.g. an LCD screen. According to a preferred variant, the processing unit can implement a reversible hashing or compression function in response to solicitation by a user through a special command button or possibly after a predetermined number of unit dose dispensing operations. Instead of an electronic reader or a terminal capable of communicating with the device (which might be too costly for some customers), information in the memory or generated by the processing unit could be collected by a human being, e.g. notably linked with the history of unit dose dispensing. To do this, the user reads a short alphanumeric code preferably between four and sixteen characters to limit the user's effort and the risk of returning incorrect information by consulting the device's human-machine interface 53. The user can then communicate this code by telephone, fax, E-mail, etc. The invention provides that the human-machine interface may additionally or alternatively consist of a loudspeaker or more generally any means enabling a human being to perceive information. The invention provides that all communication with the processing unit should be protected through conventional techniques, e.g. by coding and/or signature and/or authentication, etc.

To preclude the possibility of malicious secondary use of a device according to the invention or to prevent any attempt to alter the content of the memory of a processing unit housed in a device, said memory can advantageously be designed to be non-erasable.

So that the processing unit notably generates a history of unit doses dispensing, the invention also concerns a process implemented by the processing unit of a device according to the invention. Such a process notably includes a step to timestamp every unit dose taken out of the chamber and dispensed. To do this, the processing unit cooperates with the command mechanism that triggers the dispensing of a unit dose or with a sensor that detects such dispensing. The presence of a clock within the processing unit allows it to timestamp a dispensing operation. Any timestamp technique can be employed, e.g. using GMT as a reference or any other reference that can be used by the processing unit to increment a counter of time units. The processing unit can also implement a process comprising a step to encode and transmit to the outside world information generated from content of the processing unit's memory, e.g. the dispensing history.

So that a processing unit can implement such a process, its initialization or programming can advantageously involve computer software containing one or more program instructions which, when interpreted or executed by the processing unit, launch a process as mentioned above. Such software could be downloaded or preloaded in a memory cooperating with the processing unit at the time of assembly of the device or during its personalization process.

The invention claimed is:

1. A device for dispensing unitary doses of an active substance in a solid medication form, comprising:

a chamber to house a plurality of unit doses containing said active substance, the chamber comprising a lower base having an opening of a size and configured to receive one of the plurality of unit doses through the opening;

a disc having an opening of a size similar to the size of the opening at the lower base of the chamber and one or more recesses, wherein the disc is configured to be in close distance to and in torsion movement relative to the lower base of the chamber so that the opening of the disc can be in alignment with the opening of the lower base to cause dispensing of the received unit dose; and a torsion shaft positioned along an axis of the chamber and has an upper end and a base and one or more protuberances extending upward from the base, the upper end extending into the chamber through the disc and the lower base of the chamber, the upper end is fixed to the lower base of the chamber, wherein the torsion shaft is operable to cause the disc to be in torsion movement relative to the lower base of the chamber and further wherein the one or more recesses are positioned to receive the one or more protuberances of the base of the torsion shaft.

2. The device according to claim 1, further comprising materials for absorbing humidity to maintain a dry atmosphere inside the chamber.

3. The device according to claim 1, is further configured to require a sliding user action and a rotatory user action simultaneously to trigger the dispensing of the unit dose.

4. The device according to claim 1, further comprising a receptacle configured to collect the dispensed unit dose.

5. The device according to claim 1, further comprising:

a sensor configured to detect a unit dose dispensing; and a housing accommodating a processing unit cooperating with said sensor and a power source that supplies necessary electrical energy for the operation of said processing unit, wherein said processing unit further comprises a timer and a memory configured to respectively timestamp and record each dispensing of a unit dose detected by the sensor.

6. The device according to claim 1, further comprising a seal, an adhesive strip or a lock accessory for attesting that no unit dose has ever been dispensed before.

7. The device according to claim 1, wherein the upper end of the torsion shaft is fixed to the lower base of the chamber by means of one or more longitudinal lugs or stoppers.

8. The device according to claim 1, further comprises an envelope formed by outer walls of the chamber.

9. The device according to claim 8, wherein the envelope is thermoformed.

10. The device according to claim 8, wherein the envelope and the chamber are joined together by welding, glue or clips.

11. The device according to claim 8, wherein the envelope comprises one or more engraved or printed guilloche motifs in areas of weakness or weak breaking zones of the envelope configured to attest, emphasize or accentuate an alteration of the integrity of the envelope.

12. The device according to claim 8, further comprising a housing accommodating a processing unit and a power source that supplies required electrical energy for the operation of said processing unit, wherein said processing unit comprises a timer and a memory configured to respectively timestamp and record a time when the dispensing of the unit dose is triggered.

13. The device according to claim 12, wherein the envelope encloses the chamber and the housing.

14. The device according to claim 12, wherein the processing unit comprises a wireless communication interface.

15. The device according to claim 12, wherein the processing unit comprises a hard-wired communication interface.

16. The device according to claim 12, wherein the processing unit is coupled to a human-machine interface and configured to cause the human-machine interface to output information stored in the memory or generated by the processing unit.

17. The device according to claim 12, wherein the memory comprises a first and a second identifier stored therein, wherein the first and second identifiers are respectively dedicated to the device and an operator who filled the chamber before the envelope was sealed.

18. The device according to claim 12, wherein the memory comprises an identifier stored therein, wherein the identifier characterizes the active substance in a solid dosage form that is housed in the chamber.

19. The device according to claim 12, wherein the memory of the processing unit is non-erasable.

20. A method for transmitting information about dispensing unitary doses of an active substance in a solid pharmaceutical form using a dispensing device, wherein the dispensing device comprises:

a chamber to house a plurality of unit doses containing said active substance, the chamber comprising a lower base having an opening of a size and configured to receive one of the plurality of unit doses through the opening;

a disc having an opening of a size similar to the size of the opening at the lower base of the chamber and one or more recesses, wherein the disc is configured to be in close distance to and in torsion movement relative to the lower base of the chamber so that the opening of the disc can be in alignment with the opening of the lower base to cause dispensing of the received unit dose;

a torsion shaft positioned along an axis of the chamber and has an upper end and a base and one or more protuberances extending upward from the base, the upper end extending into the chamber through the disc and the lower base of the chamber, the upper end is fixed to the lower base of the chamber, wherein the torsion shaft is operable to cause the disc to be in torsion movement relative to the lower base of the chamber and further wherein the one or more recesses are positioned to receive the one or more protuberances of the base of the torsion shaft;

a housing accommodating a processing unit coupled to a human interface and comprising a clock and a memory configured to respectively timestamp and record a time when the received unit dose is dispensed;

the method comprising the steps of:

timestamping, by the processing unit, a time when each unit dose is dispensed, recording in the memory, by the processing unit, information about the dispensing of unit doses that includes the timestamp, encoding, by the processing unit, the recorded information, and outputting, by the human-machine interface, the encoded information.

* * * * *